US010998119B2

(12) United States Patent
Lim

(10) Patent No.: US 10,998,119 B2
(45) Date of Patent: May 4, 2021

(54) COIL COMPONENT

(71) Applicant: SAMSUNG ELECTRO-MECHANICS CO., LTD., Suwon-si (KR)

(72) Inventor: Bong Sup Lim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/000,129

(22) Filed: Jun. 5, 2018

(65) Prior Publication Data

US 2019/0156986 A1 May 23, 2019

(30) Foreign Application Priority Data

Nov. 22, 2017 (KR) ..... 10-2017-0156354

(51) Int. Cl.

| | |
|---|---|
| ***H01F 27/28*** | (2006.01) |
| ***H01F 27/29*** | (2006.01) |
| ***H01F 27/32*** | (2006.01) |
| ***H01F 17/00*** | (2006.01) |

(52) U.S. Cl.

CPC ..... *H01F 27/2804* (2013.01); *H01F 17/0013* (2013.01); *H01F 27/29* (2013.01); *H01F 27/292* (2013.01); *H01F 27/323* (2013.01); *H01F 2027/2809* (2013.01)

(58) Field of Classification Search

CPC ..... H01F 27/2804; H01F 2027/2809; H01F 27/29; H01F 27/323

USPC ..... 336/200, 232

See application file for complete search history.

(56) References Cited

U.S. PATENT DOCUMENTS

| | | | | |
|---|---|---|---|---|
| 8,188,828 | B2 | 5/2012 | Noma et al. | |
| 8,514,049 | B2 | 8/2013 | Sugiyama et al. | |
| 2009/0256668 | A1* | 10/2009 | Noma | H01F 17/0013 336/200 |
| 2011/0187486 | A1* | 8/2011 | Sugiyama | H01F 17/0013 336/200 |
| 2012/0062348 | A1* | 3/2012 | Hashimoto | H01F 17/0013 336/192 |

(Continued)

FOREIGN PATENT DOCUMENTS

| | | | |
|---|---|---|---|
| CN | 101589444 | A | 11/2009 |
| CN | 102187408 | A | 9/2011 |
| JP | 2000150241 | A * | 5/2000 |

(Continued)

OTHER PUBLICATIONS

The First Office Action dated Oct. 10, 2020 in Chinese Patent Application No. 201811128319.7 (English translation).

*Primary Examiner* — Tszfung J Chan

(74) *Attorney, Agent, or Firm* — Morgan, Lewis & Bockius LLP

(57) ABSTRACT

A coil component includes a body part in which a plurality of body sheets are stacked, an internal coil disposed in the body part and including a plurality of internal electrode patterns each disposed on a respective one of the plurality of body sheets, and an external electrode part electrically connected to both ends of the internal coil. A first internal area of a first internal electrode pattern disposed on one of the plurality of body sheets is smaller than a second internal area of a second internal electrode pattern disposed on another of the plurality of body sheets.

14 Claims, 7 Drawing Sheets

(56) References Cited

U.S. PATENT DOCUMENTS

| | | | | |
|---|---|---|---|---|
| 2013/0176096 | A1* | 7/2013 | Takahashi | H01F 27/2804 336/200 |
| 2015/0371755 | A1* | 12/2015 | Im | H01F 27/2804 336/200 |

FOREIGN PATENT DOCUMENTS

| | | | | |
|---|---|---|---|---|
| JP | 2002-100520 | A | | 4/2002 |
| JP | 2010219136 | A | * | 9/2010 |
| JP | 2016-009790 | A | | 1/2016 |
| KR | 10-2013-0046108 | A | | 5/2013 |

* cited by examiner

COIL COMPONENT

CROSS-REFERENCE TO RELATED APPLICATION(S)

This application claims benefit of priority to Korean Patent Application No. 10-2017-0156354 filed on Nov. 22, 2017 in the Korean Intellectual Property Office, the disclosure of which is incorporated herein by reference in its entirety.

BACKGROUND

1. Field

The present disclosure relates to a coil component.

2. Description of Related Art

An inductor is a type of coil component and is a passive element commonly used in electronic circuits together with a resistor and a capacitor. As electronic devices in which electronic circuits are formed are miniaturized, efforts are being made to also miniaturize coil components such as inductors.

Accordingly, chip inductors formed using lamination methods have recently been developed. Such laminated inductors are generally required to be usable at high frequencies of 100 MHz or more, due mainly to a self resonance frequency (SRF) of a high frequency band and low specific resistance.

In addition, in order to reduce loss in a frequency of a device, high quality factor Q characteristics are commonly requested, and the possibility of adjusting inductance is also requested. Accordingly, a need exists for coil components having coils whose shape and structure can be optimized to finely adjust inductance characteristics while satisfying high Q characteristics.

SUMMARY

An aspect of the present disclosure may provide a coil component which may satisfy high Q characteristics and may easily adjust inductance.

According to an aspect of the present disclosure, a coil component may include a body part, an internal coil, and an external electrode part. The body part includes a plurality of body sheets stacked therein. The internal coil is disposed in the body part and includes a plurality of internal electrode patterns each disposed on a respective one of the plurality of body sheets. The external electrode part is electrically connected to both ends of the internal coil. A first internal area of a first internal electrode pattern disposed on one of the plurality of body sheets may be smaller than a second internal area of a second internal electrode pattern disposed on another of the plurality of body sheets.

According to another aspect of the present disclosure, a coil component may include a body part in which a plurality of body sheets are stacked. An internal coil is disposed in the body part and includes a plurality of internal electrode patterns each disposed on a respective one of the plurality of body sheets. External electrodes are connected to respective ends of the internal coil through leading electrode patterns. The plurality of body sheets of the body part may include a first body sheet on which a first leading electrode pattern and a first internal electrode pattern are disposed, and a second body sheet on which a second internal electrode pattern is disposed. A width of the first internal electrode pattern is wider than a width of the second internal electrode pattern.

According to a further aspect of the present disclosure, a coil component includes a body and a coil disposed in the body and comprising a plurality of coil windings. The plurality of coil windings includes a first coil winding having a first internal area and a second coil winding having a second internal area larger than the first internal area. In one example, a coil conductor of the first coil winding is wider than a coil conductor of the second coil winding.

In the summary, all of features of the present disclosure are not mentioned. Various units for solving an object of the present disclosure may be understood in more detail with reference to specific exemplary embodiments of the following detailed description.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
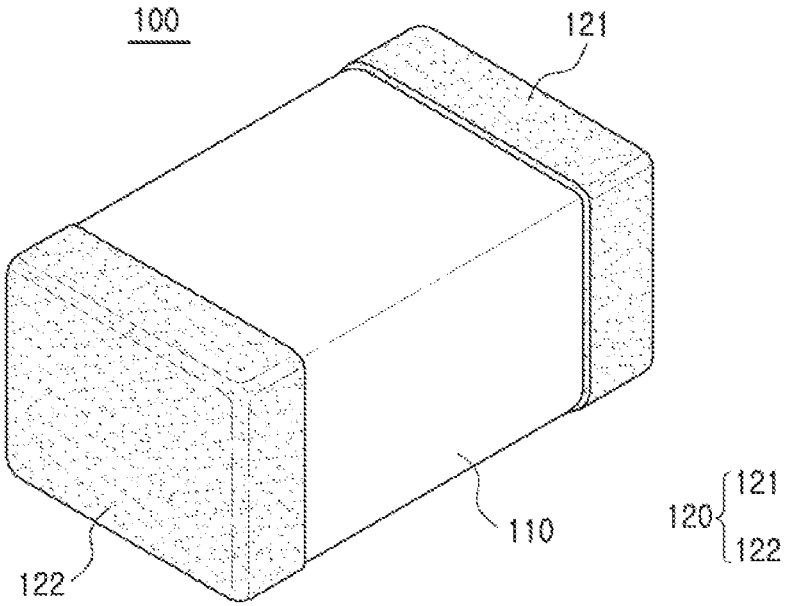
FIG. 1 is a perspective view illustrating one example of a coil component according to an exemplary embodiment.

Hereinafter, exemplary embodiments will be described in detail with reference to the accompanying drawings.

Electronic Device

A coil component according to an exemplary embodiment may be any of a variety of coil components applicable to or usable in an electronic device.

It may be appreciated that various kinds of electronic components including coil components are used in electronic devices. For example, an application processor, a direct current (DC) to DC converter, a communications processor, a wireless local area network (WLAN) device, Bluetooth (BT) device, a wireless fidelity (WiFi) device, a frequency modulation (FM) device, a global positioning system (GPS) device, a near field communications (NFC) device, a power management integrated circuit (PMIC), a battery, a switched-mode battery charger (SMBC), a liquid crystal display (LCD), an active matrix organic light emitting diode (AMOLED) device, an audio codec, a universal serial bus (USB) 2.0/3.0 device, a high definition multimedia interface (HDMI), a camera or webcam (CAM), and the like, may be used.

Here, various kinds of coil components may be appropriately used within or between these electronic components depending on their purposes in order to remove noise, or the like. For example, one or more of a power inductor, a high frequency (HF) inductor, a general bead, a bead for a high frequency (GHz), a common mode filter, and the like, may be used.

In more detail, the power inductor may be used to store electricity in a magnetic field form to maintain an output voltage, thereby stabilizing power. In addition, the high frequency (HF) inductor may be used to perform impedance matching to secure a required frequency or cut off noise and/or an alternating current (AC) in a component. Further, the general bead may be used to remove noise from power and signal lines or remove a high frequency ripple. Further, the bead for a high frequency (GHz) application may be used to remove high frequency noise from a signal line and a power line related to an audio. Further, the common mode filter may be used to pass a current therethrough in a differential mode and remove only common mode noise.

An electronic device may be typically a smartphone, but is not limited thereto. The electronic device may also be, for example, a personal digital assistant, a digital video camera, a digital still camera, a network system, a computer, a monitor, a television, a video game, a smartwatch, or an automobile. The electronic device may also be various other electronic devices in addition to the devices described above.

Coil Component

Hereinafter, a coil component, particularly a power inductor, will be described for convenience of explanation. However, the coil component according to the present disclosure may also be applied as the coil components for various other purposes as described above.

Meanwhile, the phrases "positioned at the side portion, the upper portion, or the lower portion" are used to refer to placements including placements in which a target component is positioned in a corresponding direction to that referenced but does not directly contact a reference component, as well as placements in which the target component directly contacts the reference component in the corresponding direction. However, these directions are defined for convenience of explanation, and the claims are not particularly limited by the directions defined as described above.

Figure 2:
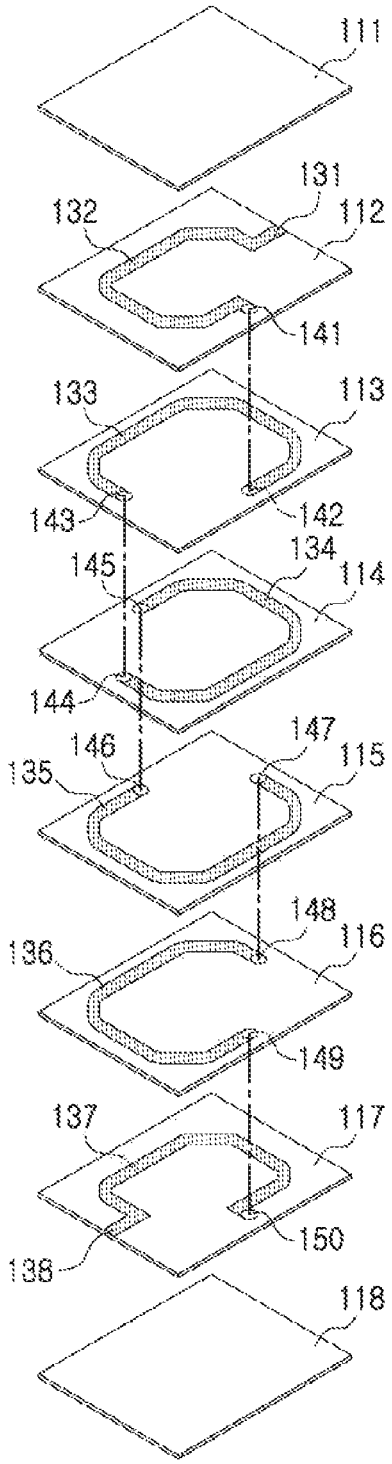
FIG. 2 is a schematic exploded perspective view of one example of a coil component according to an exemplary embodiment.

FIG. 1 is a perspective view illustrating one example of a coil component according to an exemplary embodiment and FIG. 2 is a schematic exploded perspective view of one example of a coil component according to the exemplary embodiment.

Referring to FIGS. 1 and 2, a coil component 100 may include a body part 110 including an internal coil, and an external electrode part 120. In the illustrated example, the external electrode part 120 may include a first external electrode 121 connected to one end of the internal coil, and a second external electrode 122 connected to the other end of the internal coil.

The body part 110 may substantially determine an outer shape of the coil component 100. The body part 110 may include first and second surfaces opposing each other in a first direction, third and fourth surfaces opposing each other in a second direction, and fifth and sixth surfaces opposing each other in a third direction. The body part 110 may have an approximately hexahedral shape, but is not limited thereto. Six corners at which the first to sixth surfaces meet each other may be rounded by grinding, or the like.

A material forming the body part 110 may be appropriately selected in consideration of characteristics to be implemented by the coil component. For example, in a case in which the coil component 100 is applied to a high frequency inductor, a ceramic powder, or the like may be used so that a closed magnetic path is easily formed using a dielectric material.

According to the present exemplary embodiment, a manufacturing method configuring the body part 110 is not particularly limited. Various methods may be used as the manufacturing method configuring the body part 110. For example, a stacking method for stacking a plurality of dielectric sheets, disposing a conductive material for an internal coil on each of the sheets, and then connecting the sheets to each other through one or more via(s) may be used. Alternatively, as another example, a method for encapsulating and embodying an internal coil of a spiral shape which is manufactured in advance with a dielectric material or the like may also be used.

Here, an example in which the body part 110 is formed by stacking a plurality of body sheets 112 to 117 will be described, but the body part 110 may also be formed by the method for encapsulating and embodying the internal coil of the spiral shape which is manufactured in advance with the dielectric material or the like.

The body sheets 112 to 117 may be formed in a thin plate shape, and a plurality of internal electrode patterns 132 to 137 may be formed on upper surfaces of the plurality of body sheets 112 to 117, respectively. In addition, the plurality of internal electrode patterns 132 to 137 may be connected to each other through via electrodes 141 to 150 penetrating through the body sheets, thereby forming the internal coil.

The ends of the internal coil may be connected to the first and second external electrodes 121 and 122, respectively, through a leading electrode pattern. In the example illustrated in FIG. 2, a first leading electrode pattern 131 connected to one end of the first internal electrode pattern 132 and to the first external electrode pattern 121 may be formed on a first body sheet 112. In addition, a second leading electrode pattern 138 connected to one end of a sixth internal electrode pattern 137 and to the second external electrode pattern 122 may be formed on a sixth body sheet 117.

The body part 100 may include protective sheets 111 and 118. The protective sheets 111 and 118 may be body sheets on which the electrode patterns are not formed. However, in the present specification, the protective sheets 111 and 118 and the body sheets 112 to 117 will be described as different names.

Meanwhile, at least some body sheets 112 and 117 of the plurality of body sheets included in the body part 100 may have an electrode pattern style different from the remaining body sheets 113 to 116.

For example, a first internal area formed by the first internal electrode pattern formed on at least a portion of the plurality of body sheets may be smaller than a second internal area formed by the second internal electrode pattern formed on at least another portion of the plurality of body sheets.

Figure 3:
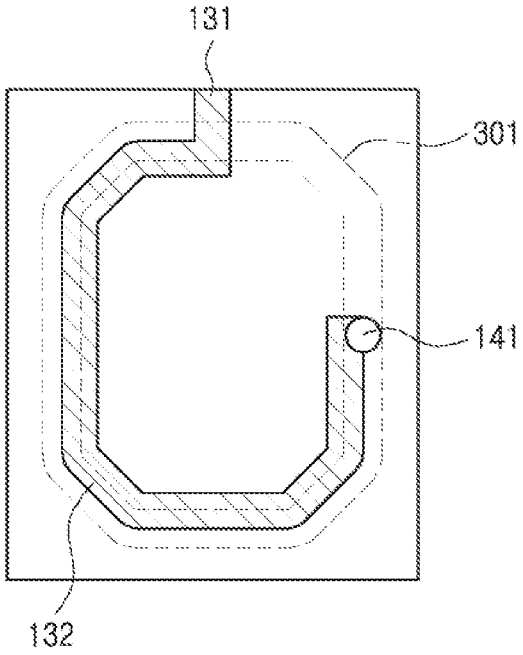
FIG. 3 is a plan view illustrating one example of a first body sheet illustrated in FIG. 2.

FIG. 3 is a plan view illustrating one example of a first body sheet illustrated in FIG. 2. Hereinafter, a more detailed description will be provided with reference to FIG. 3.

Referring to FIGS. 2 and 3, the first leading electrode pattern 131 and the first internal electrode pattern 132 may be formed on the first body sheet 112. The second leading electrode pattern 138 and the sixth internal electrode pattern 137 may be formed on the sixth body sheet 117.

Meanwhile, shapes of the first and sixth internal electrode patterns 132 and 137 are different from a shape (shown in dashed lines at 301) of at least one internal electrode pattern formed on another body sheet. That is, the reference numeral 301 in FIG. 3 corresponds to an overlapped shape of the internal electrode patterns formed on at least one of the second to fifth body sheets 113 to 116 (e.g., formed on one, two, three, or all of the second to fifth body sheets 113 to 116).

That is, as illustrated in FIG. 3, the internal electrode patterns of some body sheets 112 and 117 may have an internal area smaller than the internal electrode patterns formed on other body sheets 113 to 116. Equivalently, the internal electrode patterns of some body sheets 113 to 116 may have an internal area larger than the internal electrode patterns formed on other body sheets 112 and 117.

As such, inductance of the coil component may be adjusted by adjusting the internal areas of the internal electrode patterns formed on the body sheets.

$$L = \mu\mu_0 \frac{AN^2}{\ell} \quad \text{[Equation 1]}$$

Equation 1 represents inductance L of the coil component. In Equation 1, L is inductance, $\mu$ is permeability of a material of a core, $\mu_0$ is vacuum permeability, A is an internal area of a coil, N is the number of turns of the coil, and l is a length of a magnetic path.

Therefore, the coil component may have its entire inductance adjusted by changes in the internal areas A of the internal electrode patterns of some of the body sheets.

In addition, according to an exemplary embodiment, the internal areas A of the internal electrode patterns of some of the body sheets may be adjusted so as to have shapes similar to shapes of the internal areas of the internal electrode patterns of other body sheets. Accordingly, even in a case in which warpage in an alignment of the coil component occurs, since the shapes of the internal areas are similar to each other, capacity dispersion may be significantly reduced.

Meanwhile, in the example illustrated in FIG. 2, it is illustrated that the first internal electrode patterns 132 and 137, having the smaller internal area than other internal electrode patterns, are formed on the uppermost layer and lowest layer body sheets. That is, the body sheets which are directly connected to the external electrodes (and/or have shorter coil conductor lengths separating them from the external electrodes) have patterns with smaller internal areas, but the positions at which the first internal electrode patterns 132 and 137 are formed are not necessarily limited thereto.

As an example, the first body sheet on which the first internal electrode pattern having the smaller internal area than other internal electrode patterns is formed may also be any one of the uppermost layer body sheet and the lowest layer body sheet of the body sheets.

As another example, the internal electrode pattern having the smaller internal area than other internal electrode patterns may additionally or alternatively be formed on any one or more of the intermediate layer body sheets, for example on body sheets other than the uppermost layer body sheet and the lowest layer body sheet of the body sheets.

Hereinafter, the internal area of the internal electrode pattern will be described in more detail with reference to FIG. 2 and FIGS. 4A through 4C.

Figure 4A:
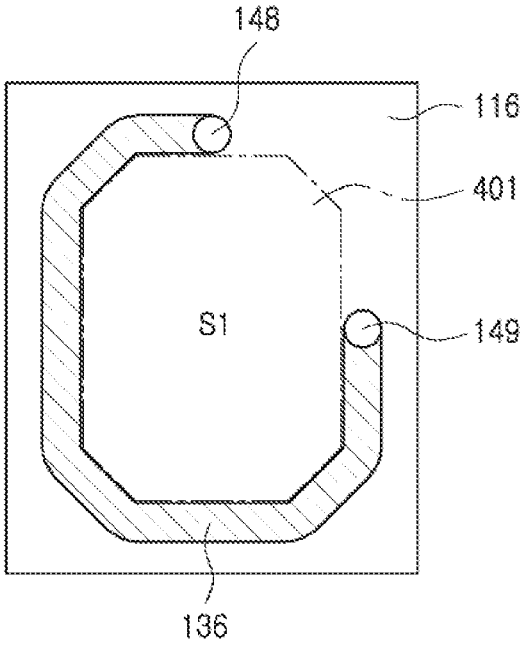
FIG. 4A is a plan view illustrating one example of a fifth body sheet illustrated in FIG. 2.
Figure 4B:
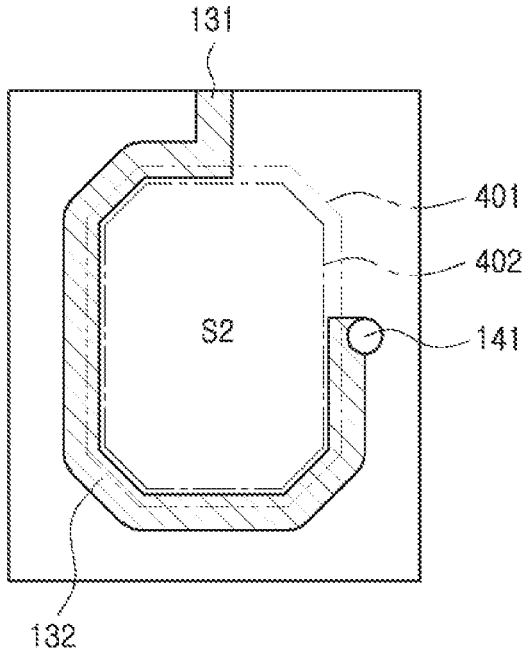
FIGS. 4B and 4C are plan views illustrating various examples of first body sheets overlapped with the fifth body sheet.
Figure 4C:
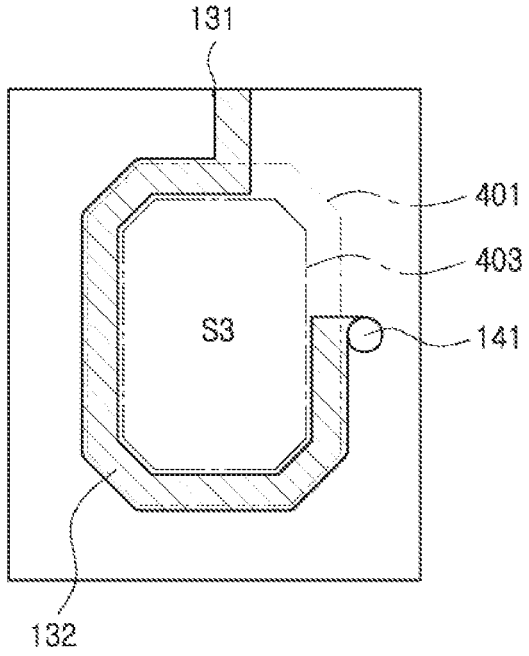

FIG. 4A is a plan view illustrating one example of a fifth body sheet 116 illustrated in FIG. 2 and FIGS. 4B and 4C are plan views illustrating two different examples of the first body sheet 122 compared with the second body sheet 113.

Referring to FIGS. 2 and 4A, the internal coil pattern 136 formed on the fifth body sheet 116 may have an internal area S1 401. As illustrated, the internal area S1 401 may be determined by the internal coil pattern 136 of the fifth body sheet, and inside lines of other internal coil patterns 133, 134, and 135 having the same internal area as the internal coil pattern 136. For example, the internal area S1 401 may be a closed area that is bounded at its periphery by an internal edge of the coil pattern 136 and by internal edges of the other internal coil patterns 133, 134, and 135 that have substantial overlap with coil pattern 136. In this regard, we note that coil patterns 133-136 may substantially overlap with each other in a stacking direction of the coil, and that where one internal coil pattern 136 has a gap (e.g., between vias 148 and 149 in pattern 136), the internal area S1 may be bounded by the internal edge of other one(s) of the overlapping coil patterns 133-135.

Meanwhile, FIG. 4B illustrates an example of the first internal coil pattern 132 determined according to a first reduction rate and FIG. 4C illustrates an example of the first internal coil pattern 132 determined according to a second reduction rate greater than the first reduction rate.

It may be seen from FIG. 4B that an internal area S2 402 of the first internal coil pattern 132 determined according to the first reduction rate is smaller than the internal area S1 401 of the internal coil pattern 136 formed on the fifth body sheet 116 (and illustratively shown in overlap as a dash-dotted line in FIG. 4B). In addition, it may be seen from FIG. 4C that an internal area S3 403 of the first internal coil pattern 132 determined according to the second reduction rate is also smaller than the internal area S1 401 of the internal coil pattern 136 formed on the fifth body sheet 116 (and illustratively shown in overlap as a dash-dotted line in FIG. 4C). Additionally, it can be seen that the internal areas S2 402 and S3 403 of the first internal coil pattern 132 overlap with the internal area S1 401 of the internal coil pattern 136 in a stacking direction of the body sheets (which also corresponds to a direction of a coil axis passing through centers of each of the plurality of coil windings).

As an example, a width of the first internal coil pattern 132 may correspond to (or be substantially equal to) a width of the internal coil pattern 136 formed on the fifth body sheet 116. In addition, a shape of at least a portion of the first internal coil pattern 132 may be similar to the internal coil pattern 136 but may correspond to a reduction of a shape of at least a portion of the internal coil pattern 136. Additionally, the first internal coil pattern 132 may overlap with the internal coil pattern 136 in a stacking direction of the body sheets (which also corresponds to a direction of a coil axis passing through centers of each of the plurality of coil windings).

Accordingly, the internal areas S2 and S3 of the first internal coil pattern 132 may correspond to reductions by predetermined ratios of the internal area S1 of the internal coil pattern 136 formed on fifth body sheet 116.

Meanwhile, as described above, since the internal areas S2 and S3 of the first internal coil pattern 132 are smaller than the internal areas of other internal coil patterns (including the internal coil pattern 136 formed on the fifth body sheet 116), a position of the via electrode in the first internal coil pattern 132 may be different from a position of the via electrode in other internal coil patterns.

That is, in the fifth body sheet 116, the via electrodes 148 and 149 may be connected to the internal coil pattern 136, while in the first internal coil pattern 132, the via electrode 141 may be connected to an outer portion of the first internal electrode pattern 132.

Hereinabove, the examples having the same coil pattern width have been described with reference to FIGS. 2, 3, and 4A through 4C.

Hereinafter, examples in which the coil pattern widths are different from each other will be described with reference to FIGS. 5, 6, and 7A through 7C. However, description of contents that are substantially the same as or easily understood from those described above with reference to FIGS. 2, 3, and 4A through 4C will be hereinafter omitted to avoid redundant description.

Figure 5:
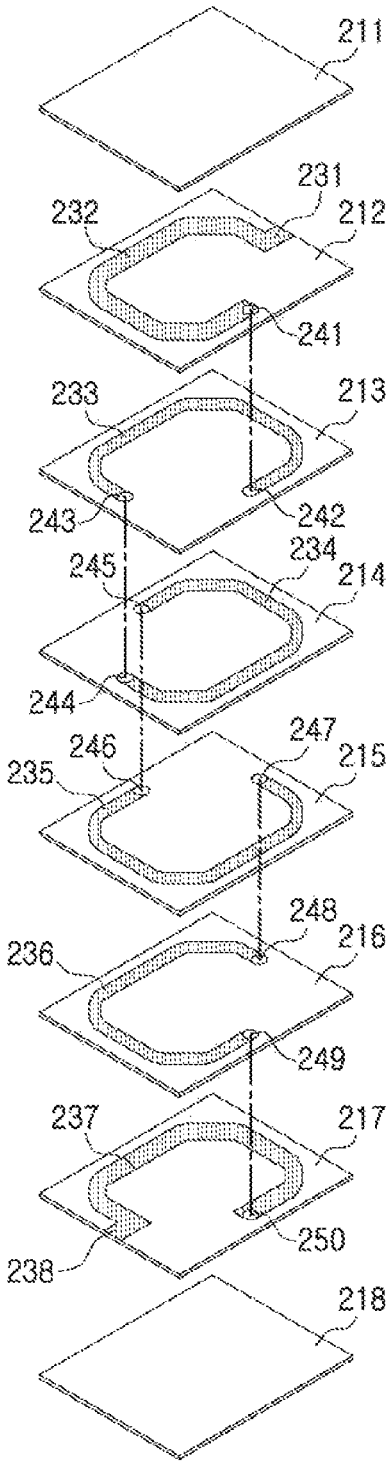
FIG. 5 is a schematic exploded perspective view of another example of a coil component according to an exemplary embodiment.
Figure 6:
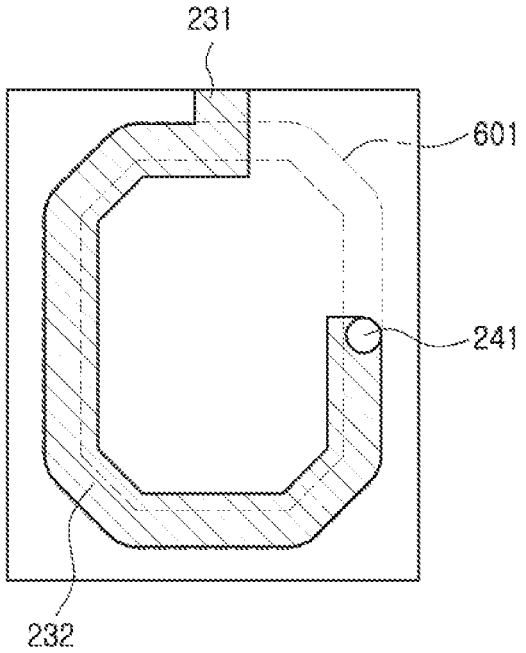
FIG. 6 is a plan view illustrating one example of a first body sheet illustrated in FIG. 5.

FIG. 5 is a schematic exploded perspective view of another example of a coil component according to an exemplary embodiment and FIG. 6 is a plan view illustrating one example of a first body sheet illustrated in FIG. 5.

Referring to FIGS. 5 and 6, first and second internal electrode patterns 232 and 237 may be formed on first and sixth body sheets 212 and 217, respectively.

Shapes of the first and sixth internal electrode patterns 232 and 237 may be different from a shape (shown in dashed lines at 601) of at least one internal electrode pattern (e.g., 232) formed on another body sheet. That is, the reference numeral 601 in FIG. 6 corresponds to an overlapped shape of the internal electrode patterns formed on at least one of the second to fifth body sheets 213 to 216.

As illustrated in FIG. 6, the internal electrode patterns 232 and 237 of some body sheets 212 and 217 may have an internal area smaller than the internal electrode patterns 604 formed on other body sheets (e.g., 213 to 216).

That is, while outer edges or lines of the first and second internal electrode patterns 232 and 237 may correspond to (or overlap in a stacking direction with) the outer edges or lines of the internal electrode pattern 601 formed on other body sheets 213 to 216, widths of the patterns may differ. Specifically, pattern widths of the first and second internal electrode patterns 232 and 237 may be wider than a pattern width of the internal electrode pattern 601 formed on other body sheets 213 to 216.

Accordingly, internal areas of the first and sixth internal electrode patterns 232 and 237 formed on the first and sixth body sheets 212 and 217 may be smaller than an internal area of the internal electrode pattern 601 formed on other body sheets 213 to 216.

Figure 7A:
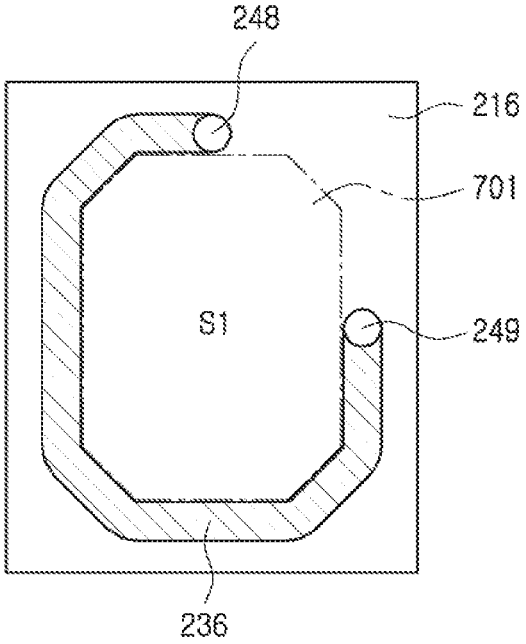
FIG. 7A is a plan view illustrating one example of a fifth body sheet illustrated in FIG. 5.
Figure 7B:
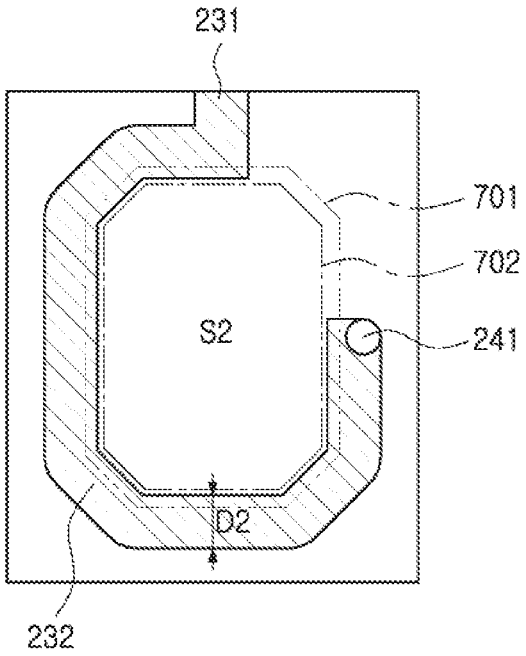
FIGS. 7B and 7C are plan views illustrating various examples of first body sheets overlapped with the fifth body sheet.
Figure 7C:
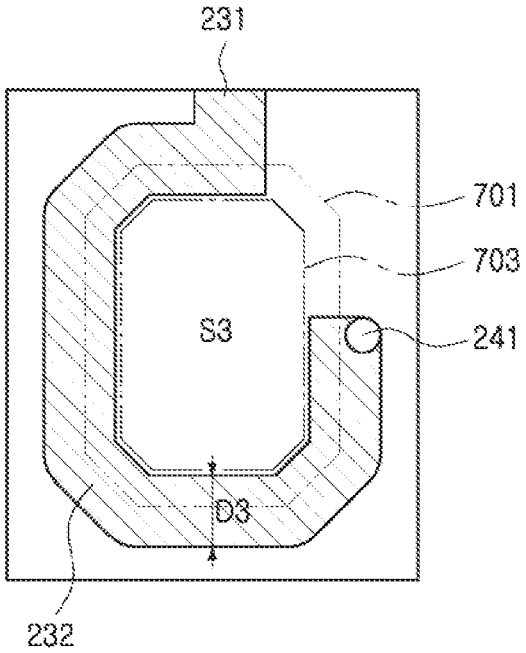

FIG. 7A is a plan view illustrating one example of a fifth body sheet 216 illustrated in FIG. 5. FIGS. 7B and 7C are plan views illustrating examples of the first body sheets 212 compared with the fifth body sheet 216.

Referring to FIGS. 5 and 7A, the internal coil pattern 236 formed on the fifth body sheet 216 may have an internal area S1 701. As illustrated, the internal area S1 701 may be determined by the internal coil pattern 236 of the fifth body sheet 216, and inside lines of other internal coil patterns 233, 234, and 235 having the same internal area as the internal coil pattern 236.

Meanwhile, FIG. 7B illustrates an example of the first internal coil pattern 232 determined according to a first reduction rate, and FIG. 7C illustrates an example of the first internal coil pattern 232 determined according to a second reduction rate greater than the first reduction rate.

It may be seen from FIG. 7B that an internal area S2 702 of the first internal coil pattern 232 is smaller than the internal area S1 701 of the internal coil pattern 236 formed on the fifth body sheet 216. In addition, it may be seen from FIG. 7C that an internal area S3 703 of the first internal coil pattern 232 is also smaller than the internal area S1 701 of the internal coil pattern 236 formed on the fifth body sheet 216.

As an example, a width of the first internal coil pattern 232 may be greater than a width of the internal coil pattern 236 formed on the fifth body sheet 216. Accordingly, the internal areas S2 and S3 of the first internal coil pattern 232 may correspond to reductions by predetermined ratios of the internal area S1 of the internal coil pattern 236 formed on fifth body sheet 216.

Meanwhile, as described above, since the pattern width of the first internal coil pattern 232 is wider than the pattern widths of other internal coil patterns, a position of the via electrode 241 in the first internal coil pattern 232 may be different from a position of the via electrode 241 in other internal coil patterns.

That is, in the fifth body sheet 216, the via electrodes 248 and 249 may be connected to the internal coil pattern 236, while in the first internal coil pattern 232, the via electrode 241 may be connected to be adjacent to an outer portion of a line width of the first internal electrode pattern 232.

Meanwhile, the meaning of an "electrical connection" of one component to another component includes a case in which one component is physically connected to another component and a case in which one component is not physically connected to another component. It can be understood that when an element is referred to with "first" and "second", the element is not limited thereby. The terms "first" and "second" may be used only for a purpose of distinguishing one element from another element, and may not limit the sequence or importance of the elements. In some cases, a first element may be referred to as a second element without departing from the scope of the claims set forth herein. Similarly, a second element may also be referred to as a first element.

In addition, a term "example" used in the present disclosure does not necessarily mean the same exemplary embodiment, but is provided in order to emphasize and describe different unique features. However, exemplary embodiments provided herein are considered to be able to be implemented by being combined in whole or in part one with another. For example, one element described in a particular exemplary embodiment, even if it is not described in another exemplary embodiment, may be understood as being amenable to being integrated in the other exemplary embodiment, unless an opposite or contradictory description is provided therein.

In addition, terms used in the present disclosure are used only in order to describe an example rather than limit the scope of the present disclosure. In this case, singular forms include plural forms unless interpreted otherwise in context.

As set forth above, according to the exemplary embodiments, the coil component may satisfy the high Q characteristics and may easily adjust the inductance.

In addition, according to an exemplary embodiment, even in the case in which warpage occurs between the coil patterns, the capacity dispersion may be significantly reduced.

While exemplary embodiments have been shown and described above, it will be apparent to those skilled in the art that modifications and variations could be made without departing from the scope of the present invention as defined by the appended claims.

What is claimed is:

1. A coil component comprising:

a body part in which a plurality of body sheets are stacked;

an internal coil disposed in the body part and comprising a plurality of internal electrode patterns each disposed on a respective one of the plurality of body sheets; and first and second external electrode parts electrically connected to respective ends of the internal coil by respective first and second lead patterns, wherein the first and second external electrode parts are electrically connected to each other only through the internal coil, a first internal area of a first internal electrode pattern disposed on one of the plurality of body sheets having the first or second lead pattern thereon is smaller than a second internal area of a second internal electrode pattern disposed on another one of the plurality of body sheets free of the first and second lead patterns, and dimensions of the first internal area in two orthogonal directions are smaller than dimensions of the second internal area in the two orthogonal directions.

2. The coil component of claim 1, wherein the first internal area corresponds to a reduction of the second internal area by a predetermined ratio.

3. The coil component of claim 1, wherein a shape of at least a portion of the first internal electrode pattern corresponds to a reduction of a shape of at least a portion of the second internal electrode pattern.

4. The coil component of claim 1, wherein a width of the first internal electrode pattern is equal to a width of the second internal electrode pattern.

5. The coil component of claim 4, further comprising:

a via electrode connected to an outer edge of the first internal electrode pattern, wherein the via electrode is connected to the second internal electrode pattern.

6. The coil component of claim 1, wherein a width of the first internal electrode pattern is wider than a width of the second internal electrode pattern.

7. The coil component of claim 6, wherein an outer edge of the first internal electrode pattern overlaps with an outer edge of the second internal electrode pattern in a stacking direction of the plurality of body sheets.

8. The coil component of claim 1, wherein the first internal electrode pattern is disposed on a first body sheet having thereon a leading electrode pattern directly connected to the external electrode part.

9. The coil component of claim 8, wherein the first body sheet is one of an uppermost body sheet and a lowest body sheet among the plurality of body sheets stacked in the body part.

10. A coil component comprising:

a body;

a coil disposed in the body and comprising a plurality of coil windings including a first coil winding having a first internal area and a second coil winding having a second internal area larger than the first internal area;

a via electrode extending in a first direction between the first and second windings to connect the first and second windings; and first and second external electrodes disposed on outer surfaces of the body and connected to opposite ends of the coil, wherein, in the first direction, the via electrode overlaps an outer edge of the first coil winding and is arranged within inner and outer edges of the second coil winding, dimensions of the first internal area in two orthogonal directions are smaller than dimensions of the second internal area in the two orthogonal directions, the first coil winding having the first internal area is directly connected to a lead pattern extended to the first external electrode, and the first and second external electrodes are electrically connected to each other only through the coil.

11. The coil component of claim 10, wherein the coil has a coil axis passing through centers of each of the plurality of coil windings, and the first internal area of the first coil winding overlaps with the second internal area of the second coil winding in a direction of the coil axis.

12. The coil component of claim 10, wherein the coil has a coil axis passing through centers of each of the plurality of coil windings, and a coil conductor of the first coil winding overlaps with a coil conductor of the second coil winding in a direction of the coil axis.

13. The coil component of claim 10, wherein a coil conductor of the first coil winding is wider than a coil conductor of the second coil winding.

14. The coil component of claim 13, wherein the coil has a coil axis passing through centers of each of the plurality of coil windings, and an outer peripheral edge of the coil conductor of the first coil winding overlaps with an outer peripheral edge of the coil conductor of the second coil winding in a direction of the coil axis.

* * * * *